US006201463B1

(12) United States Patent
Yamashita et al.

(10) Patent No.: US 6,201,463 B1
(45) Date of Patent: Mar. 13, 2001

(54) INVERTER TRANSFORMER

(75) Inventors: Kunihiko Yamashita; Shigetoshi Watanabe; Minoru Nakano, all of Tsurugashima (JP)

(73) Assignee: Toko, Inc. (JP)

( * ) Notice: Subject to any disclaimer, the term of this patent is extended or adjusted under 35 U.S.C. 154(b) by 0 days.

(21) Appl. No.: 09/410,196

(22) Filed: Sep. 30, 1999

(30) Foreign Application Priority Data

Oct. 13, 1998 (JP) ..... 10-290988

(51) Int. Cl.[7] ..... H01F 27/30
(52) U.S. Cl. ..... 336/198; 336/200
(58) Field of Search ..... 336/198, 200, 336/208, 223, 232, 178, 83

(56) References Cited

U.S. PATENT DOCUMENTS 4,060,783 * 11/1977 Harnden, Jr. ..... 336/61
4,587,506 * 5/1986 Hoeksma ..... 336/178
4,931,761 * 6/1990 Kijima ..... 336/160

FOREIGN PATENT DOCUMENTS 6124842 5/1994 (JP) .
6-163287 * 6/1994 (JP) .
10-233325 * 9/1998 (JP) .

* cited by examiner

*Primary Examiner*—Lincoln Donovan
*Assistant Examiner*—Tuyen Nguyen
(74) *Attorney, Agent, or Firm*—Norris, McLaughlin & Marcus P.A.

(57) ABSTRACT

An inverter transformer comprises an insulation bobbin (10) having a spool (12); a primary winding (30); and a secondary winding (4). A plurality of winding grooves (14) are defined by a plurality of flanges (13) provided on the side surface of the spool (12). The primary winding (30) is provided in one (14*a*) of the winding grooves (14). Another one (14*b*) of the winding grooves which has no winding provided therein is interposed between the primary winding (30) and the secondary winding (40).

2 Claims, 3 Drawing Sheets

INVERTER TRANSFORMER

BACKGROUND OF THE INVENTION

1. Field of the Invention

The present invention relates to an inverter transformer for use with DC/AC inverter adapted to turn on cathode ray tube or the like for illuminating the back of a liquid crystal display.

2. Description of the Prior Art

In order to give a better understanding of the present invention, description will first be made with reference to FIG. 6 of the accompanying drawings, which illustrates a conventional inverter transformer wherein a primary winding 3 is wound on a cylindrical spool 2*a* of insulator bobbin 2 having terminals 1 mounted thereto; and a secondary winding 4 is provided under the bobbin 2. Further, a pair of magnetic cores 5 and 6 are disposed in abutting relationship with each other through an insulator sheet 7 and holding the bobbin 2 therebetween from above and below, thus establishing a closed magnetic circuit.

FIG. 7 illustrates distribution of electric field which occurs between two plate-like electrodes 8*a* and 8*b* disposed in opposing relationship to each other with a distance d kept therebetween. Let it be assumed that a voltage of $V_G$ volts is applied to the electrode 8*b* while the electrode 8*a* is maintained at 0 volt. For the case where the space between the electrodes 8*a* and 8*b* is filled with air alone, the electric field occurring therebetween is given by $V_G/d$ as shown by a dotted line. In contrast thereto, for the case where a dielectric body 9 is inserted between the electrodes 8*a* and 8*b*, the electric field turns out to be as shown by solid line arrows electric field $E_2$ ($=V_2/d_2$) occurring in the dielectric body 9 has a gentle slope depending on the dielectric constant of the dielectric body 9, while electric fields $E_1$ ($=V_1/d_1$) and $E_3$ ($=V_3/d_3$) occurring in the air-filled portions each represent a steep slope which is increased by an amount corresponding to the decrease in the slope caused in the dielectric body 9.

In the conventional inverter transformer such as shown in FIG. 6, resin such as varnish or the like (not shown) is filled between the primary winding 3 and the bobbin 2 and between the secondary winding 4 and the bobbin 2 in order to increase the withstand voltage. However, it may happen that the resin fails to be completely filled between the primary winding 3 or secondary winding 4 and the bobbin 2 so that bubbles or the like are generated which tend to result in formation of numerous voids. With the electrodes 8*a* and 8*b* of FIG. 7 being replaced with the primary winding 3 and secondary winding 4 respectively, the intensity of electric fields occurring in the gap portions between the primary winding 3 and the bobbin 2 and between the secondary winding 4 and the bobbin 2 is increased due to the fact that the primary and secondary windings are close to each other and the dielectric body of the bobbin 2 is interposed therebetween. As a result, corona discharge is liable to occur especially between the secondary winding 4 and the neighboring components such as cores 5, 6, primary winding 3 and etc. which assume a high voltage, thus leading to dielectric breakdown.

SUMMARY OF THE INVENTION

Accordingly, it is an object of the present invention to provide an inverter transformer arranged such that a portion where a high electric field occurs is provided to be remote from the secondary winding so that the intensity of electric filed occurring in the vicinity of the secondary winding turns out to be reduced, thereby increasing the withstand voltage of the inverter transformer.

It is another object of the present invention to provide an inverter transformer comprising: an insulating bobbin including a base portion having terminals attached thereto, and a spool upwardly extending from center of said base portion, said insulating bobbin being formed with a hole extending through said spool; a primary winding wound on said spool; a secondary winding disposed under said base portion and electromagnetically coupled to said primary winding; a pair of cores formed of a magnetic material, said pair of cores being disposed in abutting relationship with each other holding said bobbin therebetween from above and below; and a center leg provided on at lease one of said cores and adapted to be inserted in an aperture of said spool; wherein a plurality of grooves are defined by a plurality of flanges provided at side surface of said spool; said primary winding is provided in one of said grooves; said groove having no winding provided therein is interposed between said primary winding and said secondary winding; and an air gap is defined between said center leg and said secondary winding.

Other objects, features and advantages of the present invention will become apparent from the ensuing description taken in conjunction with the accompanying drawings.

DESCRIPTION OF THE PREFERRED EMBODIMENTS

Figure 1:
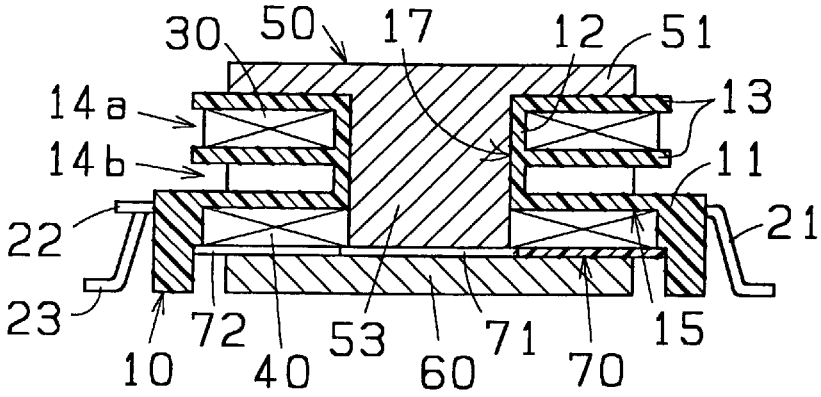
FIG. 1 is a front sectional view showing the inverter transformer including part of the components according to the present invention.
Figure 2:
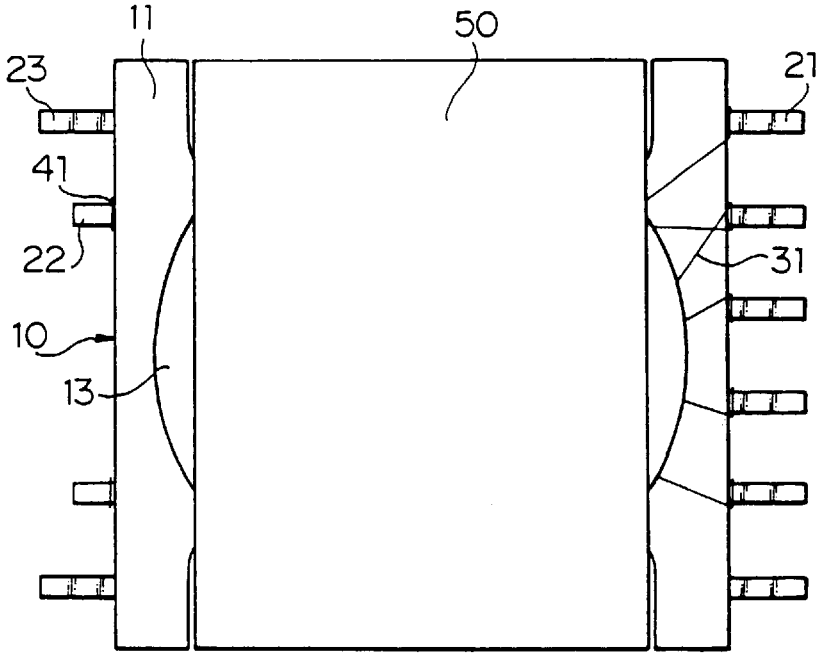
FIG. 2 is a top plan view thereof.
Figure 3:
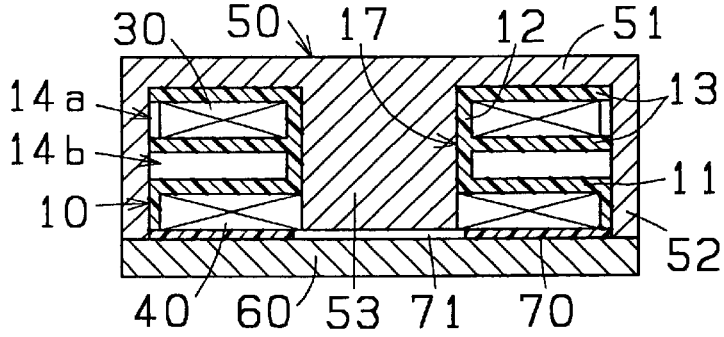
FIG. 3 is a side sectional view thereof.

Referring to FIGS. 1 to 3 of the drawings, there is shown the inverter transformer including part of the components according to the present invention wherein a bobbin 10 made of plastics comprises a base portion 11 having terminals 21 and terminals 22 and 23 attached to opposite side surfaces thereof; a spool 12 projecting upwardly from center of the base portion 11; and the bobbin 10 is formed with a hole 17 extending axially through the spool 12.

A pair of flanges 13 are on the side surfaces of the spool 12 in such a manner as to define two separate grooves 14*a*, 14*b*. A primary winding 30 is wound in the upper groove 14*a* alone, and lead wires 31 thereof are connected to terminals 21 mounted to one of the side surfaces of the bobbin 10. A feedback oscillation winding (not shown), together with the primary winding 30, is wound in the groove 14*a*, and taps of the primary winding 30 are taken out; thus, several lead wires 31 are coupled to the respective terminals.

A recess 15 is formed in the lower surface of the base portion 11, and a high-voltage secondary winding 40 is mounted therein. The secondary winding 40 is electromagnetically coupled to the primary winding 30 disposed in opposing relationship thereto, through the base portion 11 and space defined in the other groove 14*b* having no winding provided therein. Terminals 22, 23 are attached to one side surface of the base portion 11, with the terminals 22 being arranged for connection with lead wires of the secondary winding 40 and the other terminals 23 for external connection, as will be seen from FIG. 3. More specifically, the terminals 23 and shorter terminals 22 are paired on a none-to-one basis and coupled integrally to each other within the base portion 11.

Indicated at 50, 60 are cores made of a magnetic material. The pair of magnetic cores 50, 60 are disposed in abutting relationship with each other holding the bobbin 10 therebetween from above and below respectively, thereby forming a closed magnetic path. As will be seen FIG. 3, the upper core 50 is of an E-shaped cross-section comprising a plate-like portion 51, outer leg portions 52 provided integrally at the opposite ends of the plate-like portion 51, and a center leg portion 53 provided integrally at the center of the plate-like portion 51. The center leg portion 53 is inserted in hole 17 of the spool 12. The other core 60 provided at the bottom of the bobbin 10 is configured in a plate-like shape.

A thin sheet 70 of an insulator material is interposed between the cores 50 and 60, thereby establishing a construction which is less susceptible to magnetic saturation. The sheet 70 is formed with a through-aperture 71 which is slightly greater than the cross section of the center leg portion 53 of the core 50, and a slit 72 extending from one side surface of the sheet 70 to the through-aperture 71. The lead wires 41 (FIG. 2) of the secondary winding 40 are drawn out under the sheet 70 through the slit 72, and connected with the terminals 22.

As described above, the secondary winding 40 is disposed in opposing relationship to the primary winding 30 through the space of the groove 14*b* having no winding provided therein and the dielectric material of the base portion 11. With such a construction, by virtue of the fact that the space of the groove 14*b* having no winding disposed therein exists between the primary winding 30 and the secondary winding 40, electric field intensity between the secondary winding 40 and the base portion 11 is reduced so that dielectric breakdown due to corona discharge is less likely to occur.

Figure 4:
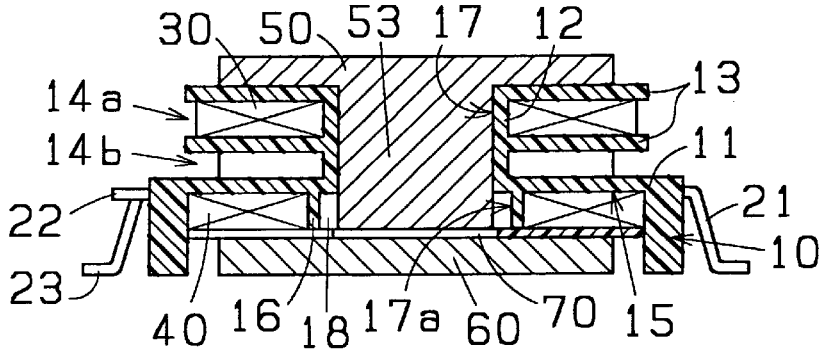
FIG. 4 is a front sectional view showing a, embodiment of the present invention.
Figure 5:
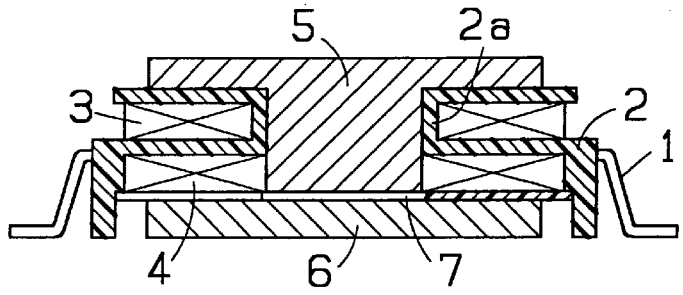
FIG. 5 is a front sectional view showing a conventional inverter transformer.
Figure 6:
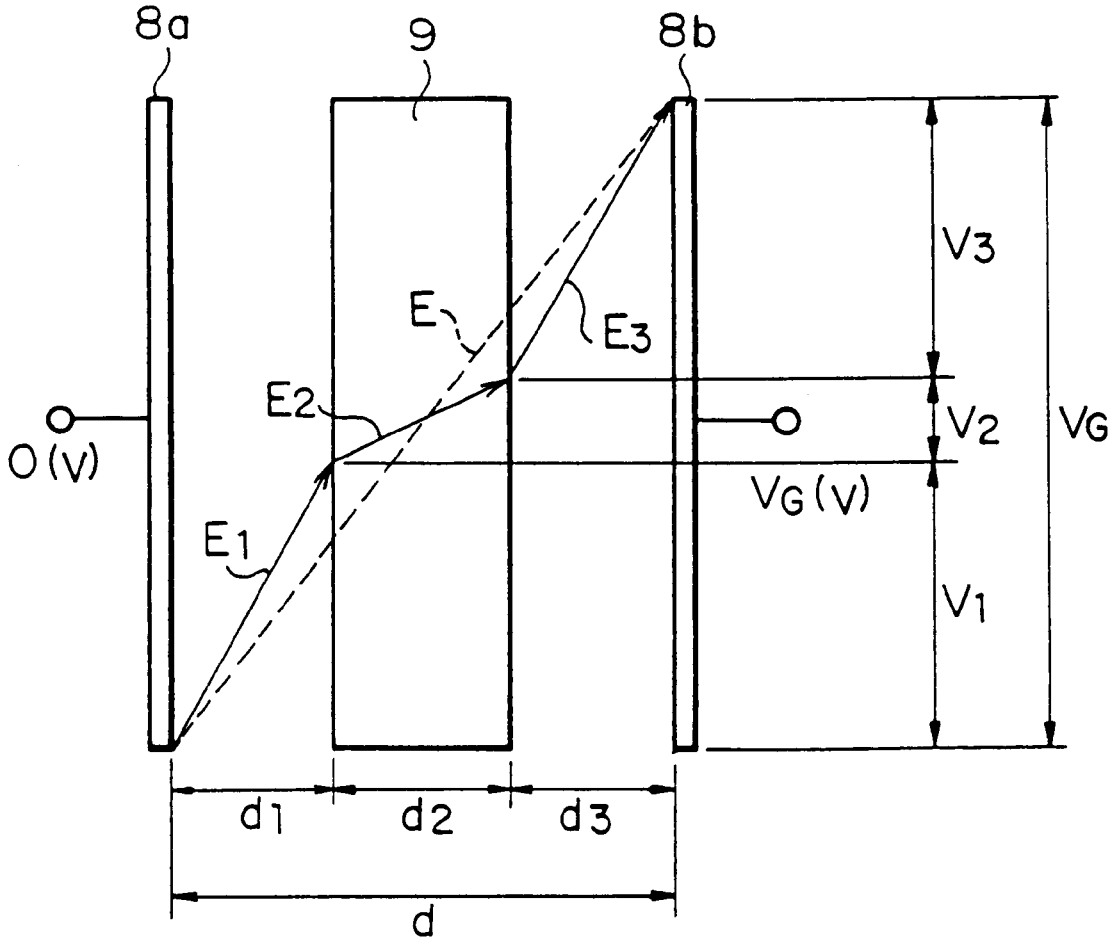
FIG. 6 is a view useful for explaining field intensity distribution.

Referring to FIG. 4, there is shown the inverter transformer according to a second embodiment of the present invention, which is similar to the inverter transformer according to the first embodiment shown in FIGS. 1 to 3, except for the configuration of lower portion of bobbin 10. More specifically, the bobbin 10 of this embodiment is provided with a cylindrical bulkhead 16 through which the hole 17 extends, the bulkhead 16 being provided integrally on the bottom surface of the base portion 11 and having an inner diameter greater than the spool 12; the hole 17 having a greater diameter at lower portion 17*a* thereof than at the remaining portion thereof.

Thus, the secondary winding 40 provided in the recess 15 outside the bulkhead 16 is disposed in opposing relationship with the center leg 53 of the core through the bulkhead 16 formed of a dielectric material and the air gap 18. That is to say, the secondary winding 40 is disposed in opposing relationship with the primary winding through gap defined by groove having no winding provided therein and with the center leg 58 through the bulkhead 16 and air gap 18. Consequently, electric field intensity in the vicinity of the secondary winding 40 is more reduced than in the arrangement of FIG. 1, thereby further enhancing the effect of preventing dielectric breakdown.

As will be appreciated from the above discussion, the arrangement according to the present invention is made such that portion where a higher electric field occurs is remote from the secondary winding so that a lower electric field occurs in the vicinity of the secondary winding, as a result of which corona discharge starting voltage turns out be higher and thus the dielectric strength of the inverter transformer can be improved.

While the present invention has been illustrated and described with respect to specific embodiments thereof, it is to be understood that the present invention is by no means limited thereto but encompasses all changes and modifications which will become possible within the scope of the appended claims.

What is claimed is:

1. An inverter transformer comprising:

an insulating bobbin including a base portion having terminals attached thereto, and a spool upwardly extending from center of said base portion, said insulating bobbin being formed with a hole extending through said spool;

a primary winding wound on said spool;

a secondary winding disposed under said base portion and electromagnetically coupled to said primary winding;

a pair of cores formed of a magnetic material, said pair of cores being disposed in abutting relationship with each other holding said bobbin therebetween from above and below; and a center leg provided on at least one of said cores and adapted to be inserted in an aperture of said spool;

wherein a plurality of grooves are defined by a plurality of flanges provided at side surface of said spool; said primary winding is provided in one of said grooves; said groove having no winding provided therein is interposed between said primary winding and said secondary winding; and an air gap is defined between said center leg and said secondary winding.

2. An inverter transformer as set forth in claim 1, wherein said hole has a greater diameter at lower end portion thereof than at the remaining portion thereof; a cylindrical bulkhead having a greater inner diameter than said spool is provided on lower surface of said base portion of said bobbin; and said secondary winding is disposed in opposing relationship to said core center leg through said bulkhead and said air gap.

* * * * *